United States Patent [19]

Schmidt

[11] 4,389,971

[45] Jun. 28, 1983

[54] MEANS FOR CONTROLLING THE APPLICATION OF GLUE TO A DEFINED AREA

[75] Inventor: Robert W. Schmidt, Oak Lawn, Ill.

[73] Assignee: Copar Corporation, Oak Lawn, Ill.

[21] Appl. No.: 30,469

[22] Filed: Apr. 16, 1979

[51] Int. Cl.[3] ..... B05C 5/00

[52] U.S. Cl. ..... 118/669; 118/682; 118/684; 118/324

[58] Field of Search ..... 118/669, 682, 683, 684, 118/685, 703, 324

[56] References Cited

U.S. PATENT DOCUMENTS

| | | | |
|---|---|---|---|
| 3,155,538 | 11/1964 | Schneider et al. | 118/2 |
| 3,252,441 | 5/1966 | Hargreaves | 118/2 |
| 3,340,847 | 9/1967 | Miller et al. | 118/2 |
| 3,491,718 | 1/1970 | Ebbert et al. | 118/685 |
| 3,496,907 | 2/1970 | Morison | 118/682 |
| 3,521,599 | 7/1970 | Bentzinger | 118/318 X |
| 3,532,907 | 10/1970 | Kasper | 307/293 |
| 3,680,529 | 8/1972 | Francis | 118/8 |
| 3,682,131 | 8/1972 | Algeri et al. | 118/2 |
| 3,908,542 | 9/1975 | Andersson | 101/79 |
| 4,013,037 | 3/1977 | Warning, Sr. et al. | 118/324 X |
| 4,164,001 | 8/1979 | Patnaude | 118/684 X |

*Primary Examiner*—John P. McIntosh

*Attorney, Agent, or Firm*—Kinzer, Plyer, Dorn & McEachran

[57] ABSTRACT

A control for regulating the application of glue to a defined area of a moving paper board box blank includes a sensor for detecting the presence of the leading and trailing edges of a moving defined glue application area; a glue applicator spaced a fixed distance from the sensor; a pulse generator providing pulses indicative of movement of the application area; and counting means which are connected to the sensor, glue applicator and pulse generator. The sensor initiates a counting action at detection of the leading edge of a glue application area. The counting means initiates glue application after a predetermined number of counted pulses representative of the fixed distance between the sensor and glue applicator. The sensor initiates a second counting action at detection of the trailing edge of a glue application area and the counting means stops glue application after the same predetermined number of pulses representative of the sensor glue applicator fixed distance.

2 Claims, 4 Drawing Figures

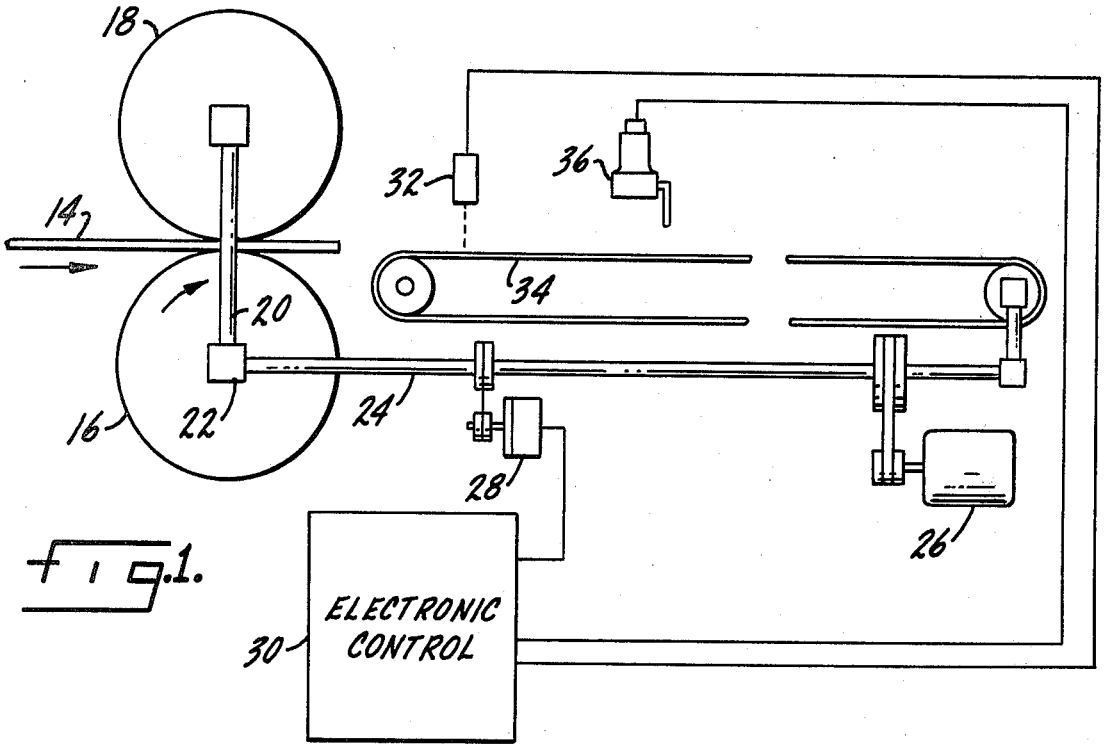
fig.1.
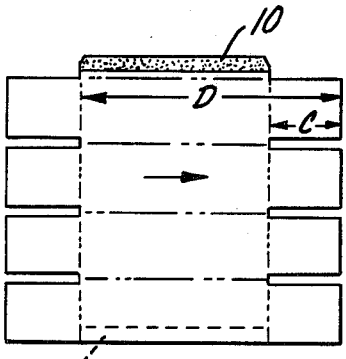
fig.2.
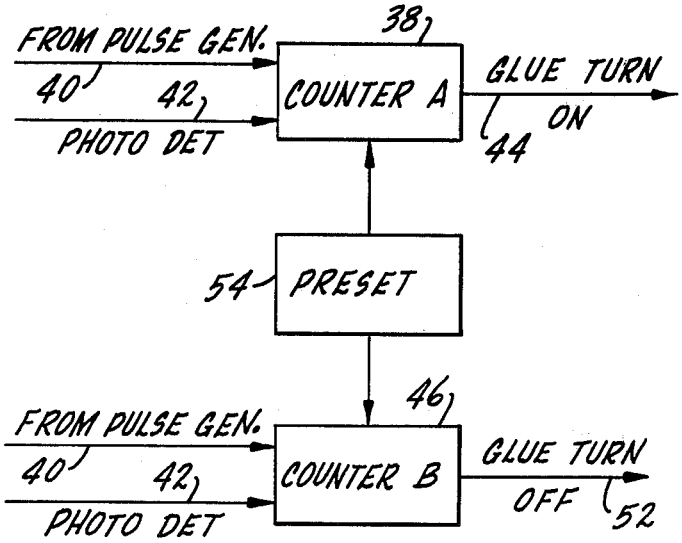
fig.3.
fig.4.
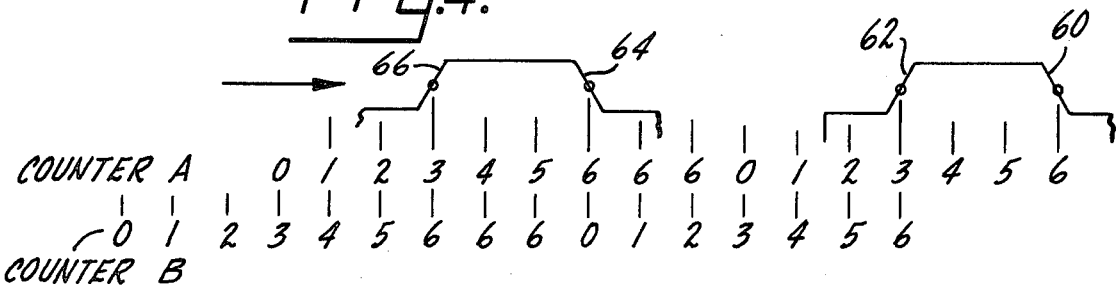

MEANS FOR CONTROLLING THE APPLICATION OF GLUE TO A DEFINED AREA

SUMMARY OF THE INVENTION

The present invention relates to a control for the application of glue to defined areas of paper board box blanks.

A primary purpose of the invention is to provide a simply constructed reliable control which initiates and terminates glue application at the precise time when the area to receive glue is at the proper position relative to the glue applicator.

Another purpose is to provide a glue applicator control which includes a sensor for detecting the leading and trailing edges of the area to be glued, a glue applicator spaced a fixed distance from the sensor, pulse generating means for providing pulses representative of the length of travel of the area to be glued, and a counter which is connected to the pulse generator, sensor and glue applicator and which is effective to initiate and stop glue application a predetermined number of counted pulses after the sensor has detected the leading and trailing edges of the glue application area.

Another purpose is to provide a control of the type described utilizing a pair of counters, one for initiating glue application and the other for initiating turn off of the glue applicator.

Other purposes will appear in the ensuing specification, drawings and claims.

BRIEF DESCRIPTION OF THE DRAWINGS

The invention is illustrated diagrammatically in the following drawings wherein:

FIG. 1 is a diagrammatic illustration of a portion of a paper board box manufacturing line, FIG. 2 is a plan view of a slotted box blank illustrating areas which may be glued, FIG. 3 is a diagrammatic illustration of the counter, and FIG. 4 is a diagrammatic illustration showing the relationship between the areas to be glued and the pulses counted by the counter as indicative of sensor-to-glue applicator distance.

DESCRIPTION OF THE PREFERRED EMBODIMENT

Looking specifically at FIG. 2, which illustrates a box blank after slotting, glue may be applied to one of two areas so that the box blank may be subsequently formed into a carton. A flap is indicated at 10 and glue may be applied to one side of the flap, or glue may be applied to an area 12 of the fourth panel on the opposite side of the box blank, and generally equal in size to the flap 10. The flap may be either on the inside or outside of the box and thus glue may be applied to either side of the flap or fourth panel. In either event, when the box is folded at the indicated score lines, the box blank can be formed into a carton tube. The present invention is specifically directed at a control for accurately applying the appropriate amount of glue to either area 10 or area 12. The glue may be applied either by extrusion or by spray. What is important is to accurately control initiation and termination of the glue application regardless of the application method used.

The present invention provides an improved electronic control for automatic glue application systems used in the manufacture of corrugated and fiber board boxes. The invention eliminates a large percentage of the electronic circuitry previously required, thus giving improved reliability. It eliminates the need for the operator to set the length and location of the glue application on the box blank and it minimizes the capacity of the counters required for controlling length.

Present systems measure the travel of the box blank through the printer slotter and the folding section by counting pulses from a pulse generator driven by a line shaft through a toothed belt so that each pulse represents a constant distance of board traveled. Because of variable gearing and other machine constants, it is impossible to provide a pulse generator which will produce the exact number of pulses required to make the instrument read in either English or metric units. Therefore, a four place multiplier (1.XXXX) manually set at the time of installation is used to multiply each pulse to make it equal the appropriate English or metric units of measure. This is done only once during installation and is not changed thereafter.

In existing control systems during installation the multiplier previously described is first established and set; then the distance from the photocell to the glue applicator is also set. Both settings are inside the control cabinet and not adjusted by the operator.

The operator sets dimensions C and D (FIG. 2) on the length setting switches on the front panel. As the blank emerges from the printer slotter, the leading edge of the blank is detected by a photoelectric sensor. A counter in the control first counts the corrected pulses up to the cell to glue applicator distance previously set; then dimension C is counted at which time the glue applicator is in the correct position to start glue flow whether it is on the flap or the fourth panel. When the counter counts dimension D-C, the glue application is stopped.

In the new design, the following circuitry and operator operation are eliminated:

1. The need to convert pulses to either English or metric measure.
2. The need for length setting switches previously set by the operator to dimensions C and D (FIG. 2).
3. The need for counters capable of counting the longest length of the glue pattern required.

In the present invention pulses are generated by a pulse generator driven by a toothed belt driven by a sprocket on the line shaft in the same way that they were on the original control, so that each pulse represents a constant length of travel of the board blank. These pulses are counted as generated and there is no necessity to multiply them by a constant to convert them to either English or metric units. Instead of detecting the leading edge of the blank, the photosensor will be positioned to detect the leading edge of the flap. When the leading edge is detected, a counter previously set to the photocell to glue applicator length starts counting up. When it reaches the preset count, the applicator will be in the correct position to start gluing so the glue valve is energized. The counter remains static until the photocell detects the trailing edge of the flap. At this point, the counter starts counting down and when it reaches zero the applicator is at the end of the flap and the control shuts the glue valve. Note that no length set switches or operator action is required. This method will work with the counter that starts counting up to the photocell to glue applicator length to start glue flow and count down the same distance to stop the glue flow, or the counter could be set to the photocell to glue applicator length and count down to zero to start the glue flow and to count up to the photocell to glue applicator distance at the end of the flap to terminate the glue flow. In other words, the direction of counting for this system is not important.

It should also be noted that since the counter which starts and stops the glue flow need only have sufficient capacity to count up the number of pulses which occur as the box blank moves from the photocell to the glue applicator that a slight slippage which might occur if a pulse generator were driven from the transport belts is of very little importance because of the small count required. In the old system, the counter counted the entire length of the glue flap, so if there was an error due to slippage, it would be much larger. This method described above will work provided that neither the flap length nor the distance between the flaps is less than the distance between the photocell and glue applicator. If the flap length was less than the distance between the photocell and glue applicator and an up counter were being used, the count down would start before the cell to gun distance had been reached and there would be no glue applied at all. For this reason, a more sophisticated system using two counters instead of one is used in some applications.

In the second system there are two counters which are referred to as counter A and counter B. Both counters are preset to the number of uncorrected pulses generated as the board travels through the distance from the photocell to the glue applicator. Counter A will always turn the gun on and counter B will always turn the gun off. In operation, counter A will be actuated when the photocell detects the leading edge of the flap and will count down from this preset length to zero. When it reaches zero, the gun will be turned on. When the photocell detects the trailing edge of the flap, it will actuate counter B which was previously preset to the cell to gun distance and when it counts down to zero, the glue gun will be shut off. In the meantime, it is possible if there were a very short distance between flaps that the photocell could already have detected the leading edge of the next flap on the next box and could already be counting down to its glue valve turn on, while counter B was still counting down to turn the valve off for the previous flap. This system will work regardless of the length of the flap or the distance between flaps. It should be noted that the preset of the two counters is in the number of pulses that occur as the box travels from photocell to applicator and not the actual length measured in English or metric units.

Since the glue applicator takes time to actuate between the instant of the electrical turn on signal and the time the glue actually reaches the board, there is circuitry available which anticipates the length of board which will pass during this delay. This correction is made while the box blank is traveling between the sensor and glue applicator and such a correction circuit is incorporated herein, although not described.

In FIG. 1, a box blank is indicated at 14 and is moving between a pair of rotating slotting drums 16 and 18. The drums are coupled together for simultaneous rotation by a shaft 20, with the bottom drum 18 being driven through a gear box 22 from a rotating line shaft 24. Shaft 24 in turn is driven from a drive motor 26.

A pulse generator indicated diagrammatically at 28 provides pulses representative of rotation of line shaft 24 which pulses are thus representative of movement of box blank 14. Pulse generator 28 is connected to a diagrammatically illustrated control 30. A photodetector or sensor is indicated at 32 and may be one of various available photocell types. Sensor 32 is positioned directly above a box blank moving on conveyor belt 34 which will receive a slotted blank from drums 16 and 18 and will move the blank beneath a glue applicator 36 which again may be either an extrusion or spray type of device. Both sensor 32 and applicator 36 are connected to control 30 and as will appear below are separated a fixed distance.

FIG. 3 illustrates portions of the control 30. A first counter or counter A is indicated at 38 and has one input 40 from pulse generator 28 and a second input 42 from the photodetector or sensor 32. The output from the counter A, indicated at 44, is used to initiate operation of glue applicator 36.

A second counter or counter B is indicated at 46 and has one input 40 from the pulse generator and a second input 42 from photodetector 32. The output from counter 46 indicated at 52 is used to terminate operation of the glue applicator. ;p Both counters A and B will have a preset count set therein which is diagrammatically represented by box 54. The preset count is precisely representative of the fixed distance between sensor 32 and glue applicator 36. The actual distance is not important. What is important is the number of pulses from pulse generator 28 representative of travel of the box blank between the sensor and the glue applicator. This number of pulses represents the length of travel that must take place from first sensing of the area to be glued until the glue applicator must actually be turned on.

FIG. 4 is a diagrammatic illustration of the manner in which the two counters control the turn on and turn off of the glue applicator. Assuming for purposes of illustration that the distance between sensor 32 and glue applicator 36 is represented by six pulses from pulse generator 28, and that the length of a flap or glue area is represented by three pulses, counter A will be preset for six counts, as will counter B. When sensor 32 detects the presence of a leading edge 60 of the first blank, it will start a countdown of counter A. Counter A will reach zero six pulses later and at that time glue applicator 36 will be turned on and leading edge 60 will be precisely at the proper point to initiate the application of glue. However, since the flap has a length represented by three pulses, sensor 32 will detect trailing edge 62 three pulses after initiation of counter A. At this point counter B will begin its countdown. After counter B reaches zero, glue applicator 36 will be turned off, again at the proper position of the box blank to terminate the application of glue. Each counter is reset to 6 as soon as it reaches zero and will remain at that number until it again receives a "count" signal from the sensor.

A second blank is following the first and its leading edge 64 will again initiate the countdown of counter A. Note at this time that counter B is still counting down to terminate glue application for the first blank. Counter A will continue until it reaches zero, at which time the glue applicator will be turned on. In like manner, trailing edge 66 of the second blank will cause counter B to initiate its counting operation and count down from six to zero, at which time the glue applicator will again be turned off.

In actual practice, the number of pulses per unit of board travel would be high enough to give the desired accuracy to the point of "turn on" and "turn off" of the glue applicator. The pulses would each usually represent less than $\frac{1}{8}$ inch of board travel. The actual length represented by each pulse is not important so the same system of control can be used for either English or metric measurement.

The present arrangement is extremely flexible in that it will accommodate glue application areas, which may be either the flap or a similar area as indicated in FIG. 2, which are equal to, longer than or shorter than the distance between detector 32 and glue applicator 36. If only glue application areas greater in length than the detector applicator distance are to receive glue, then it is only necessary to utilize one counter and the count may be either up or down. What is important is that a count precisely representative of the detector applicator distance is preset in one or two counters and the glue applicator is turned on and turned off based upon the detector's sensing the presence of the leading and trailing edges of the area to be glued and subsequently reducing the preset count to zero. The actual distance is not important, but only the number of pulses representative of box travel over that distance. Normally, this number of pulses will be experimentally determined at the time that an entire apparatus is assembled and put in operation. Once determined it need never be changed, as the speed of the conveyor, the speed of the slotting drums bears no relationship and has no effect upon the turn on and turn off of the applicator. The applicator is solely controlled by the number of pulses which are representative of box travel, regardless of how fast that travel may be.

Whereas the preferred form of the invention has been shown and described herein, it should be realized that there may be many modifications, substitutions and alterations thereto.

The embodiments of the invention in which an exclusive property or privilege is claimed are defined as follows:

1. A control for regulating the application of glue to a defined area of a moving paper board box blank including a sensor for detecting the presence of the leading and trailing edges of a moving defined glue application area, a glue applicator spaced a fixed distance from the sensor, means for generating electrical pulses representing length of travel of the glue application area, a first counter connected to said pulse generating means, sensor and glue applicator, a second counter connected to said pulse generating means, sensor and glue applicator, said sensor initiating a counting action in said first counter at detection of the leading edge of a glue application area, said first counter initiating a glue application after a predetermined number of counted pulses representative of movement of the application area through said fixed sensor to glue applicator distance, said sensor initiating a second counting action in said second counter at detection of the trailing edge of a glue application area, said second counter stopping glue application after a predetermined number of counted pulses representative of movement of the application area through said fixed sensor to glue applicator distance.

2. The control of claim 1 further characterized in that said first and second counters have a predetermined count set therein, which predetermined count is representative of said fixed sensor to glue applicator distance, pulses received in said first and second counters reducing the count with the initiation and termination of glue application taking place when the count has reached zero.

* * * * *